US009975223B2

(12) United States Patent
Chen

(10) Patent No.: US 9,975,223 B2
(45) Date of Patent: May 22, 2018

(54) LIGHTWEIGHT RATCHET WRENCH FOR WITHSTANDING HIGHER TORQUE REQUIREMENTS

(71) Applicant: Jei Mou Industrial Co., Ltd., Taichung (TW)

(72) Inventor: Po-Shen Chen, Taichung (TW)

(73) Assignee: Jei Mou Industrial Co., Ltd., Taichung (TW)

( * ) Notice: Subject to any disclaimer, the term of this patent is extended or adjusted under 35 U.S.C. 154(b) by 281 days.

(21) Appl. No.: 14/979,426

(22) Filed: Dec. 27, 2015

(65) Prior Publication Data

US 2017/0182637 A1 Jun. 29, 2017

(51) Int. Cl.
*B25B 13/46* (2006.01)

(52) U.S. Cl.
CPC ..... *B25B 13/463* (2013.01)

(58) Field of Classification Search
CPC ... B25B 13/463; B25B 13/462; B25B 13/467; B25G 1/10; B25G 1/12; B25G 1/125
See application file for complete search history.

(56) References Cited

U.S. PATENT DOCUMENTS 2,578,686 A * 12/1951 Fish ..... B25B 13/462 81/124.2
3,742,788 A 7/1973 Priest
4,722,253 A * 2/1988 Chow ..... B25B 13/463 81/62
4,986,147 A * 1/1991 Cooper ..... B25B 13/461 16/431
5,007,311 A 4/1991 Lee
5,119,701 A * 6/1992 Wei ..... B25B 13/463 81/63
5,144,869 A * 9/1992 Chow ..... B25B 13/04 81/63
5,528,963 A * 6/1996 Wei ..... B25B 13/463 81/438
5,603,247 A * 2/1997 Wei ..... B25B 13/04 81/63
5,626,061 A * 5/1997 Whitley ..... B25B 13/461 76/114

(Continued)

FOREIGN PATENT DOCUMENTS

DE 8805606 U1 6/1988
DE 20103094 U1 5/2001

(Continued)

*Primary Examiner* — David B Thomas
(74) *Attorney, Agent, or Firm* — Alan D. Kamrath; Kamrath IP Lawfirm, P.A.

(57) ABSTRACT

A ratchet wrench includes a main body made of rigid plastic and including first and second openings and a compartment. A first plate is made of rigid metal received in the first opening. A second plate is made of rigid metal received in the second opening. A ratchet driving assembly is received by the compartment and positioned between the first and second plates. The ratchet driving assembly includes a driving member and two pawls. The driving member is engaged with an object to be driven when using the ratchet wrench to drive the object. The two pawls are engagable with the driving member. The two pawls are anchored to at least one of the first and second plates and are configured to transmit a torque load to the at least one of the first and second plates.

18 Claims, 6 Drawing Sheets

(56) References Cited

U.S. PATENT DOCUMENTS 5,713,251 A * 2/1998 Zurbuchen ..... B25B 13/461 81/61
5,927,158 A * 7/1999 Lin ..... B25B 13/12 81/60
6,101,902 A * 8/2000 Wei ..... B25B 23/108 81/177.1
6,318,216 B1 * 11/2001 Eggert ..... B25B 13/04 81/124.3
7,424,837 B2 * 9/2008 Shu ..... B25B 13/463 81/177.4
7,478,577 B1 * 1/2009 Wheeler ..... B25B 13/10 81/128
8,122,790 B1 * 2/2012 Johnson, Sr. ..... B25G 1/125 81/60
8,555,751 B1 * 10/2013 Chern ..... B25G 1/00 81/121.1
8,661,947 B1 * 3/2014 Ou ..... B25B 13/463 192/43.2
8,893,590 B2 * 11/2014 Chen ..... B25B 13/462 81/60
2003/0079570 A1 * 5/2003 Chen ..... B25B 13/463 81/60
2003/0145687 A1 * 8/2003 Lin ..... B25B 13/463 81/57.29
2009/0038444 A1 * 2/2009 Hu ..... B25B 13/463 81/63.2
2009/0107299 A1 * 4/2009 Ploeger ..... B25B 13/463 81/62
2009/0229425 A1 * 9/2009 Riggio ..... B25B 13/065 81/63
2011/0179912 A1 * 7/2011 Lin ..... B25B 13/463 81/60
2013/0283983 A1 * 10/2013 Cummings ..... B25B 13/463 81/63.2
2016/0297054 A1 * 10/2016 Abunameh ..... B25B 13/481

FOREIGN PATENT DOCUMENTS

DE 20106964 U1 6/2001
DE 102009024689 B4 11/2011

* cited by examiner

LIGHTWEIGHT RATCHET WRENCH FOR WITHSTANDING HIGHER TORQUE REQUIREMENTS

BACKGROUND OF THE INVENTION

1. Field of the Invention

The present invention relates to a ratchet wrench and, in particular, to a ratchet wrench that is lightweight and that is designed to withstand higher torque requirements.

2. Description of the Related Art

U.S. Pat. No. 3,742,788 shows a ratchet wrench including a main body. The main body has a through hole defining a compartment. A ratchet driving assembly is positioned in the compartment with two plates mounted oppositely on the main body to keep the ratchet driving assembly in the compartment. A pawl of the ratchet driving assembly has a through hole, and a fastener inserts through the through hole. The pawl is pivotally anchored to the fastener. Furthermore, the fastener secures the two plates to the main body, with one of two distal ends engaging with one plate and with the other distal end engaging with the other plate. Because the pawl is movable relative to the fastener, the fastener can not effectively transmit a torque load from the pawl to the plates. In addition, the pawl is generally of a small size that will not occupy too much space of the compartment and that enables the ratchet wrench to have a compact size. Therefore, the pawl including the through hole has a weak structure and can not withstand high torque requirements.

The present invention is, therefore, intended to obviate or at least alleviate the problems encountered in the prior art.

SUMMARY OF THE INVENTION

According to the present invention, a ratchet wrench includes a main body made of rigid plastic and including a first opening, a second opening opposite the first opening, a first ledge surface, a second ledge surface opposite the first ledge surface, and a compartment extending therethrough and in communication with the first and second openings. A first plate made of rigid metal has a contour correspondingly matching to a contour of the first opening and is received in the first opening. The first ledge surface supports the first plate. A second plate made of rigid metal has a contour correspondingly matching to a contour of the second opening and is received in the second opening. The second ledge surface supports the second plate. A ratchet driving assembly is received by the compartment and positioned between the first and second plates. The ratchet driving assembly includes a driving member and two pawls. The driving member is rotatable about an axis and includes a gear. The driving member is engaged with an object to be driven when using the ratchet wrench to drive the object. The two pawls are engagable with the gear of the driving member, and one of the two pawls is configured to allow the driving member to rotate clockwise and to inhibit the driving member from rotating counterclockwise, while the other pawl is configured to allow the driving member to rotate counterclockwise and to inhibit the driving member from rotating clockwise. The two pawls are disposed in a mirror image relationship. The two pawls are anchored to at least one of the first and second plates and are configured to transmit a torque load to the at least one of the first and second plates, with the at least one of the first and second plates forming a first recess in communication with the compartment and with the two pawls each forming a first protrusion inserted in the first recess. A direction control engagable with the two pawls and configured to cause each of the two pawls to move to a first position engaging the driving member and a second position disengaging from the driving member.

DETAILED DESCRIPTION OF THE INVENTION

The present invention will become clearer in light of the following detailed description of illustrative embodiments of this invention described in connection with the drawings. It is intended that the embodiments and drawings disclosed herein are to be considered illustrative rather than restrictive.

Figure 1:
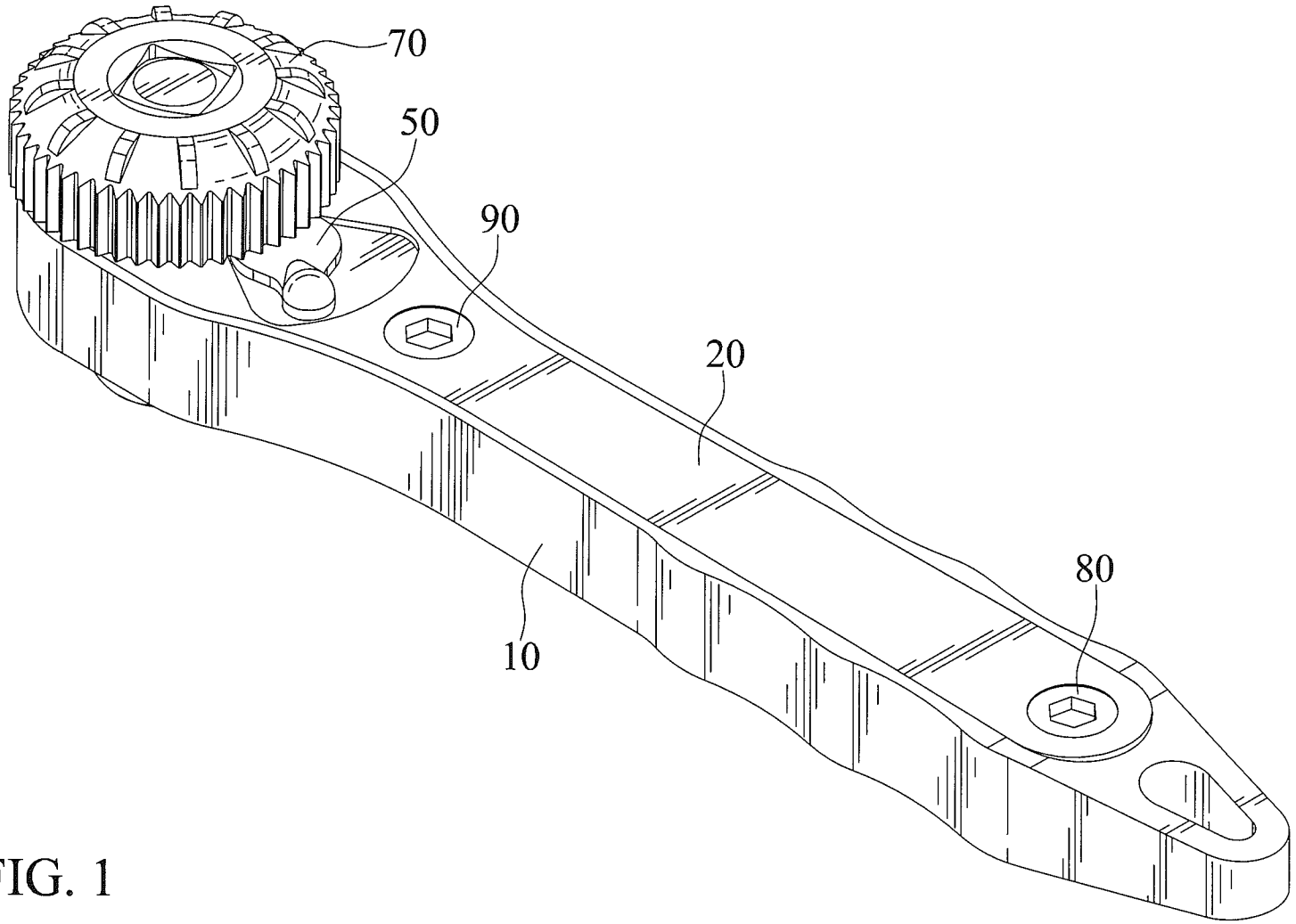
FIG. 1 is a perspective view of a ratchet wrench in accordance with the present invention.
Figure 2:
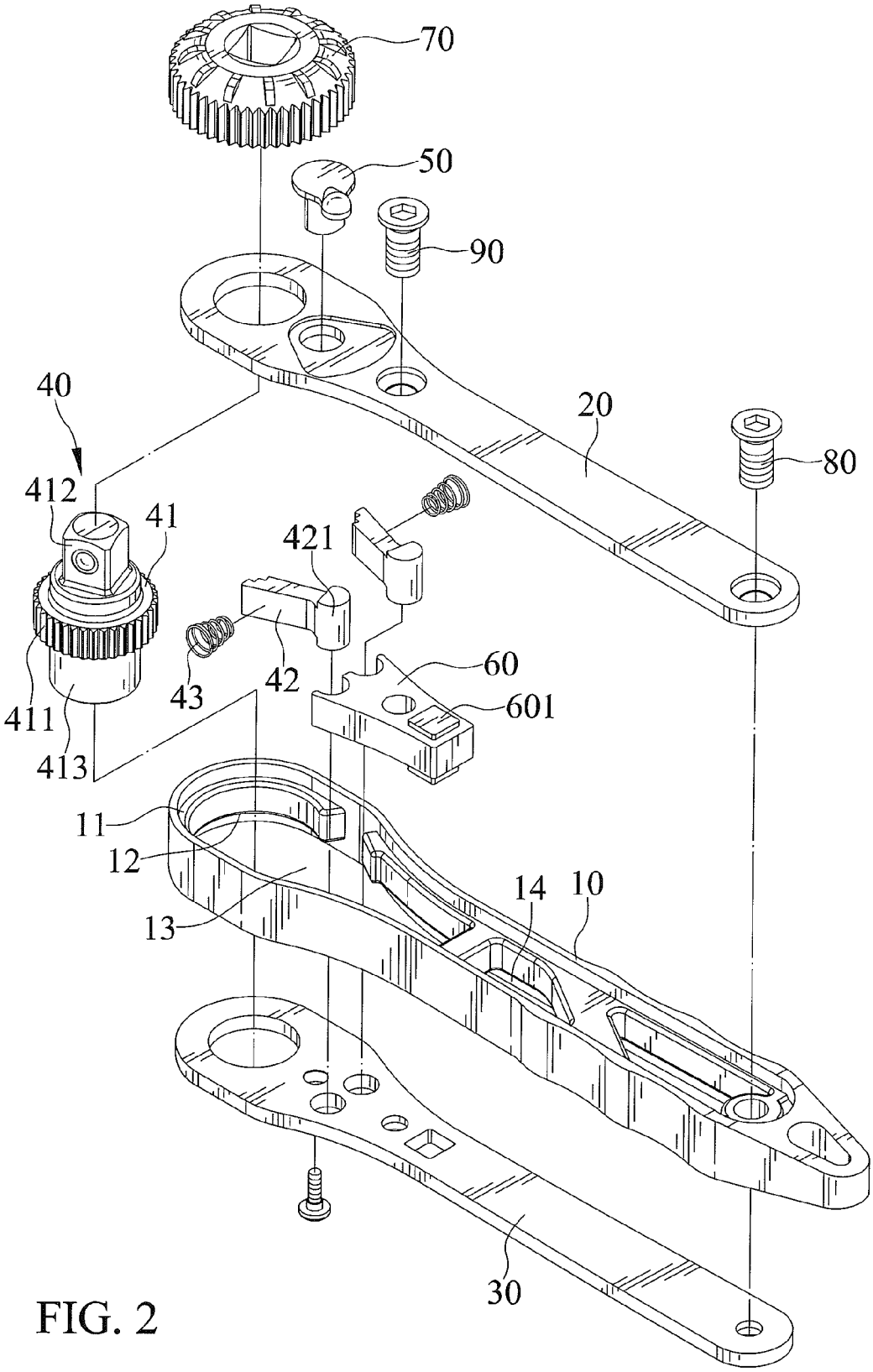
FIG. 2 is an exploded perspective view of the ratchet wrench of the present invention.
Figure 3:
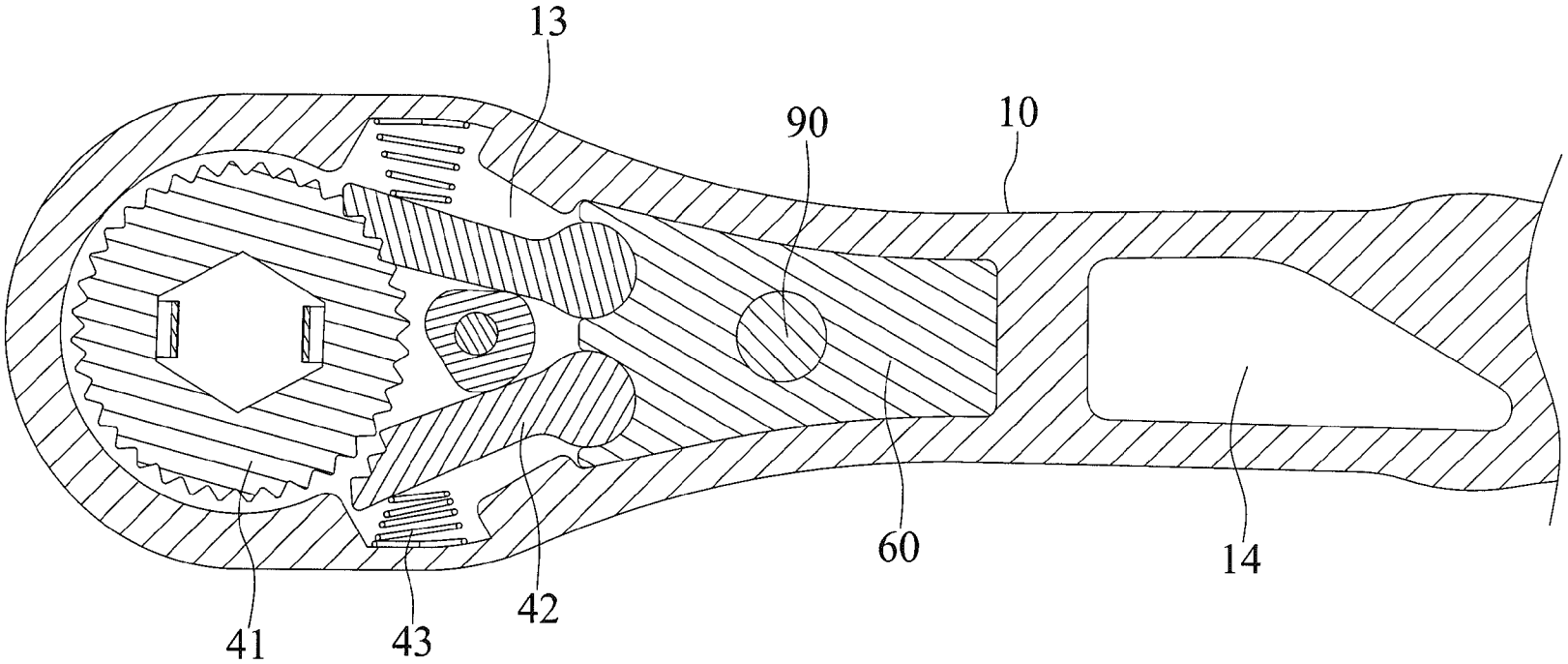
FIG. 3 is a partial cross-sectional view of the ratchet wrench of the present invention.
Figure 4:
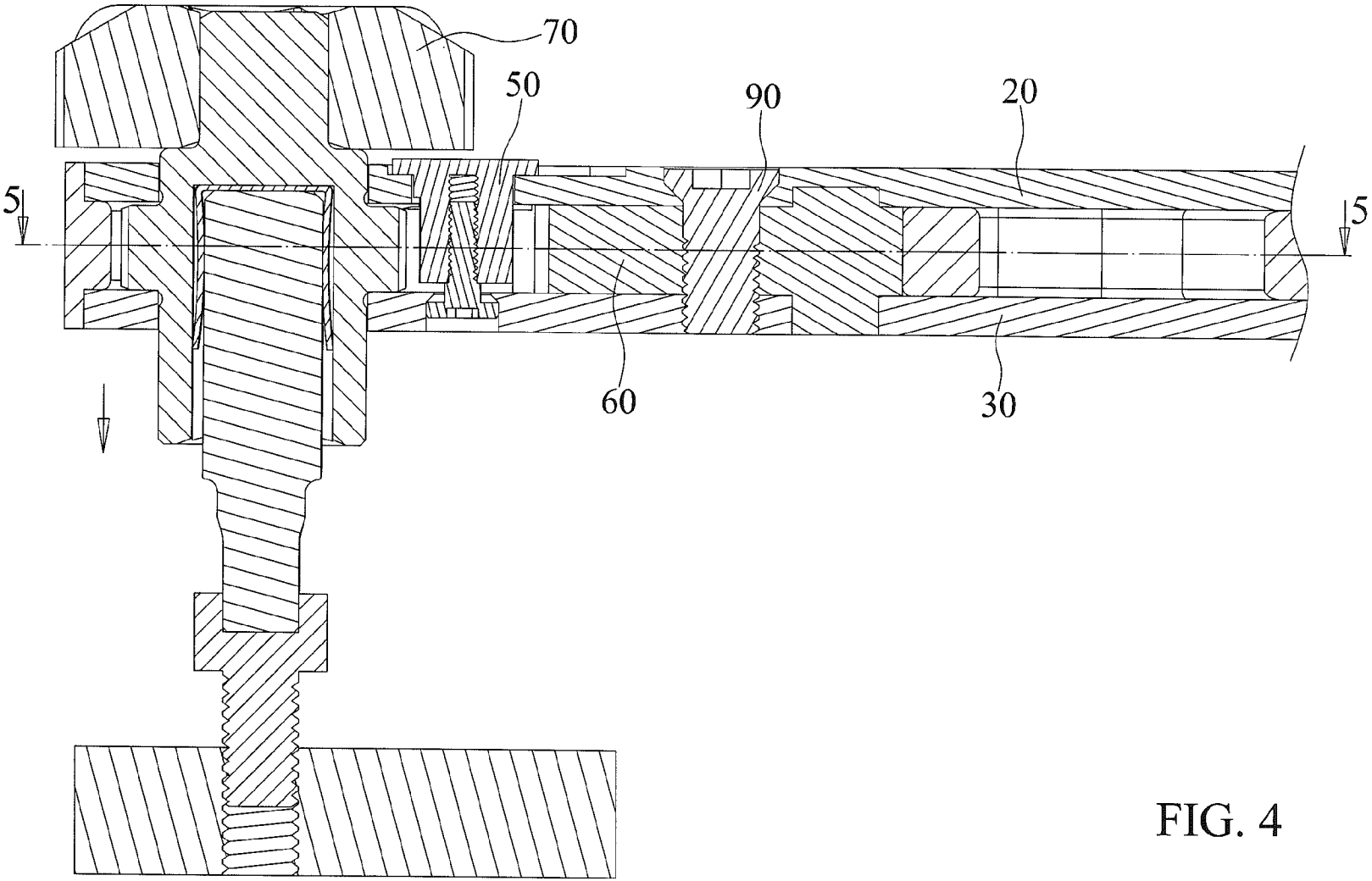
FIG. 4 is a partial cross-sectional view showing the ratchet wrench of the present invention in use of driving an object.
Figure 5:
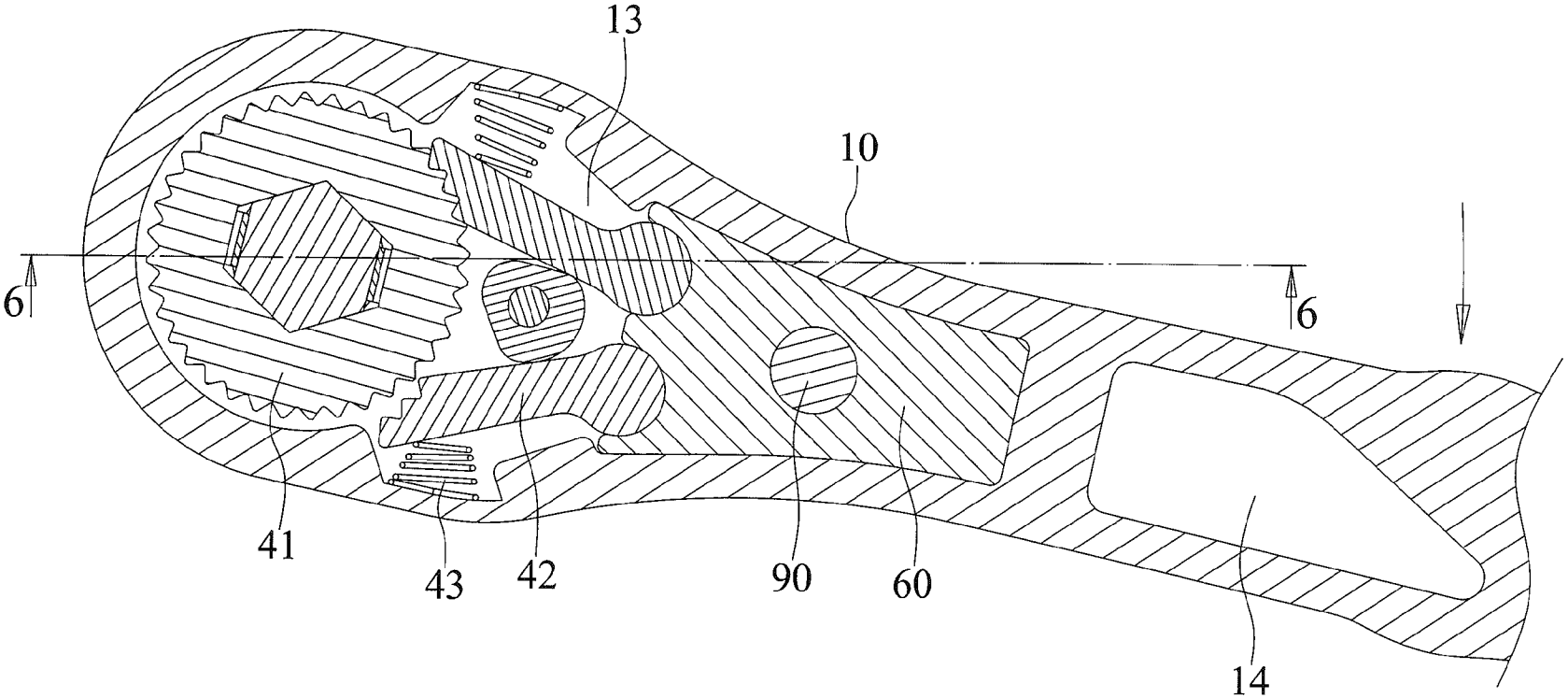
FIG. 5 is a cross-sectional view taken along line 5-5 of FIG. 4.
Figure 6:
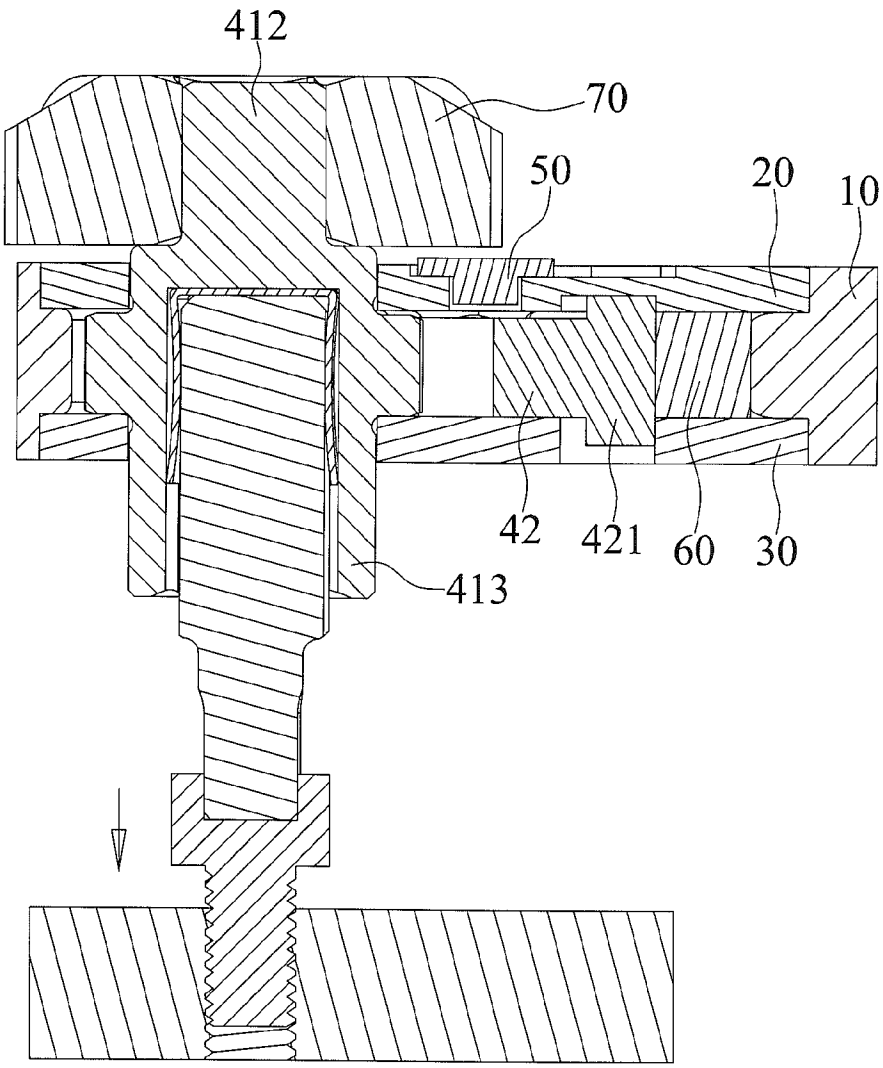
FIG. 6 is a cross-sectional view taken along line 6-6 of FIG. 5.

FIGS. 1 through 6 show a ratchet wrench in accordance with the present invention. The ratchet wrench includes a main body 10 made of rigid plastic. The main body 10 is made in one-piece. The main body 10 includes a first opening, a second opening opposite the first opening, a first ledge surface 11, a second ledge surface 12 opposite the first ledge surface 11, and a compartment 13 extending therethrough and in communication with the first and second openings. The first and second openings are defined by an inner periphery of the main body 10. The compartment 13 is also delimited by the inner periphery of the main body 10. The compartment 13 extends through the main body 10 in a direction transverse to a longitudinal direction of the main body 10. The main body 10 includes at least one hollow out 14 in communication with at least one of the first and second openings. Therefore, the main body 10 is lightweight. The main body 10 includes a first end thereof defining a contour that allows a user to grasp when operating the ratchet wrench and a second end. A first plate 20 made of rigid metal has a contour correspondingly matching to a contour of the first opening and received in the first opening. The first ledge surface 11 supports the first plate 20. A second plate 30 made of rigid metal having a contour correspondingly matching to a contour of the second opening and received in the second opening. The second ledge surface 12 supports the second plate 30. The first opening has a first contour, and the second opening has a second contour the same as the first contour, thereby the first plate 20 is adapted to be received in the second opening and the second plate 30 is adapted to be received in the first opening respectively. The main body 10 has an upper brim edge, a lower brim edge, and an outer periphery extending between the upper and lower brim edges. The first plate 20 is disposed flush with the upper brim edge and the second plate 30 is disposed flush with the lower brim edge respectively.

A ratchet driving assembly 40 is received by the compartment 13 and positioned between the first and second plates 20 and 30. The ratchet driving assembly 40 includes a driving member 41 and two pawls 42. The driving member 41 is rotatable about an axis and includes a gear 411. The driving member 41 is engaged with an object to be driven upon using the ratchet wrench to drive the object. The driving member 41 includes a first driving end 412 extending outside the first plate 20 through a first slot and a second driving end 413 extending outside the second plate 30 through a second slot respectively, and the object to be driven is engaged with one of the first and second driving ends 412 and 413. The first driving end 412 forms a drive extension. The second driving end 413 forms a socket. The two pawls 42 are made of rigid metal and are engagable with the gear 411 of the driving member 41. One of the two pawls 42 is configured to allow the driving member 41 to rotate clockwise and to inhibit the driving member 41 from rotating counterclockwise, while the other pawl 42 is configured to allow the driving member to rotate counterclockwise and to inhibit the driving member 41 from rotating clockwise. The two pawls 42 are disposed in a mirror image relationship. The two pawls 42 are anchored to the at least one of the first and second plates 20 and 30 and are configured to transmit a torque load to the at least one of the first and second plates 20 and 30, with the at least one of the first and second plates 20 and 30 forming a first recess in communication with the compartment 13 and with the two pawls 42 each forming a first protrusion 421 inserted in the first recess. The two pawls 42 are pivotally anchored to the at least one first and second plates 20 and 30. Each of the two pawls 42 is under a resilient force of a biasing member 43. The biasing member 43 has a shape including a plurality of coils.

In the embodiment, the other of the first and second plates 20 and 30 forms two second recesses in communication with the compartment 13, and each receive the first protrusions 421 of one of the two pawls 42. It is within the scope of the invention that the two first recesses extend through one of the first and second plates 20 and 30. It is within the scope of the invention that the two second recesses extend through the other of the first and second plates 20 and 30.

A direction control 50 is engagable with the two pawls 42 and is configured to cause each of the two pawls 42 to move to a first position engaging the driving member 41 and a second position disengaging from the driving member 41. The direction control 50 includes a projection which extends between the two pawls 42 and which is adapted to move each of the two pawls 42 to counteract the respective biasing member 43. Each pawl 42 includes the projection of the direction control 50 with a first end of the biasing member 43 respectively abutting one of two opposite lateral sides thereof. The biasing member 43 has a second end abutting the main body 10. The main body 10 forms a recess, and the second end of the biasing member 43 is positioned in the recess.

A torque-transmitting block 60 is received by the compartment 13. The torque-transmitting block 60 is anchored to the at least one first and second plates 20 and 30 and is configured to transmit a torque load to the at least one of the first and second plates 20 and 30, with the at least one of the first and second plates 20 and 30 forming a first cavity in communication with the compartment 13 and with the torque-transmitting block 60 forming a second protrusion 601 inserted in the first cavity. The two pawls 42 are pivotally anchored to the at least one first and second plates 20 and 30, and the respective first protrusion 421 defines a pivot axis. The torque-transmitting block 60 forms two concaves pivotally receiving the first protrusions 421 of the two pawls 42. The concaves each have a curved inner periphery, and the first protrusion 421 of the respective pawl 42 has a curved outer periphery. The torque-transmitting block 60 is configured to abridge a gap between two opposite lateral sides of the main body 10, with the torque-transmitting block 60 having a lateral side in surface-to-surface contact with an inner periphery of the main body 10. The lateral side of torque-transmitting block 60 is also in surface to surface contract with a wall extending between the two opposite lateral sides of the main body 10. The torque transmitting block 60 abridging the gap between the lateral sides of the main body 10 therefore increases the rigidity of the main body 10. Furthermore, the torque-transmitting block 60 receiving the two pawls 42 helps transmit the torque load to the at least one of the first and second plates 20 and 30. Consequently, the ratchet wrench is able to withstand even higher torque requirements.

In the embodiment, the other of the first and second plates 20 and 30 forms a second cavity in communication with the compartment 13 and receives the second protrusions 601 of the torque-transmitting block 60.

A knob 70 is releasably coupled to the driving member 41 and is configured to be rotated to turn the driving member 41. Upon rotating the knob 70 clockwise, the driving member 41 is rotated clockwise. Upon rotating the knob 70 counterclockwise, the driving member 41 is rotated counterclockwise. With the knob 70, the driving member 41 can be turned in a fast manner without leverage from the main body 10 upon using the ratchet wrench to drive the object. The knob 70 is releasably coupled to the other of the first and second driving ends 412 and 413 of the driving member 41 and configured to be rotated to turn the driving member 41. The knob 70 is coupled to the first driving end 412. The knob 70 includes a hole, and the first driving end 412 is inserted in the hole.

The first plate 20 includes at least one first aperture, the main body 10 includes at least one through aperture, and the second plate 30 includes at least one second aperture respectively. At least one fixer 80 has a first end secured to the at least one first aperture, a middle inserting through the through aperture, and a second end secured to the second aperture respectively. The at least one fixer 80 secures the main body 10 and the first and second plates 20 and 30 together. Furthermore, the first plate 20 includes a first hole, the torque-transmitting block 60 includes a through hole, and the second plate 30 includes a second hole respectively. A fastener 90 has a first end secured to the first hole, a middle inserting through the through hole, and a second end secured to the second hole respectively.

In view of the foregoing, the two pawls 42 anchored to at least one of the first and second plates 20 and 30 enable the ratchet wrench of the present invention to withstand higher torque requirements. Contrary to a conventional ratchet wrench which has a main body made of metal, the main body 10 is made of rigid plastic, thereby saving weight and the production cost of the main body 10 of a ratchet wrench. In order to reinforce the main body 10 and to enable the ratchet wrench to withstand higher torque requirements, the first and second plates 20 and 30 are made of rigid metal. In addition, each of the first and second plates 20 and 30 does not have a substantial thickness and is not bulky and weighty. Instead, each of the first and second plates 20 and 30 is in a form of a thin plate. The two pawls 42 are disposed in a mirror image relationship for transmitting the torque load without suffering stress concentration.

What is claimed is:

1. A ratchet wrench comprising:

a main body made of rigid plastic and including a first opening, a second opening opposite the first opening, a first ledge surface, a second ledge surface opposite the first ledge surface, and a compartment extending therethrough and in communication with the first and second openings;

a first plate made of rigid metal having a contour correspondingly matching to a contour of the first opening and received in the first opening, with the first ledge surface supporting the first plate;

a second plate made of rigid metal having a contour correspondingly matching to a contour of the second opening and received in the second opening, with the second ledge surface supporting the second plate;

a ratchet driving assembly received by the compartment and positioned between the first and second plates, wherein the ratchet driving assembly includes a driving member and two pawls, wherein the driving member is rotatable about an axis and includes a gear, wherein the driving member is engaged with an object to be driven when using the ratchet wrench to drive the object, wherein the two pawls are made of rigid metal and are engagable with the gear of the driving member, wherein one of the two pawls is configured to allow the driving member to rotate clockwise and to inhibit the driving member from rotating counterclockwise while another of the two pawls is configured to allow the driving member to rotate counterclockwise and to inhibit the driving member from rotating clockwise, wherein the two pawls are disposed in a mirror image relationship, wherein the two pawls are anchored to at least one of the first and second plates and are configured to transmit a torque load to the at least one of the first and second plates, with the at least one of the first and second plates forming a first recess in communication with the compartment and with the two pawls each forming a first protrusion inserted in the first recess; and a direction control engagable with the two pawls and configured to cause each of the two pawls to move to a first position engaging the driving member and a second position disengaging from the driving member; and a torque-transmitting block received by the compartment, wherein the torque-transmitting block is anchored to the at least one first and second plates and is configured to transmit a torque load to the at least one of the first and second plates, with the at least one of the first and second plates forming a second cavity in communication with the compartment and the torque-transmitting block forming a second protrusion inserted in the second cavity, and wherein the torque-transmitting block is configured to abridge a gap between two opposite lateral sides of the main body, with the torque-transmitting block having a lateral side in surface-to-surface contact with an inner periphery of the main body.

2. The ratchet wrench as claimed in claim 1, wherein the first plate includes at least one first aperture, the main body includes at least one through aperture, and the second plate includes at least one second aperture respectively, and wherein at least one fixer has a first end secured to the at least one first aperture, a middle inserting through the through aperture, and a second end secured to the second aperture respectively.

3. The ratchet wrench as claimed in claim 1, wherein the first plate includes a first hole, the torque-transmitting block includes a through hole, and the second plate includes a second hole respectively, and wherein a fastener has a first end secured to the first hole, a middle inserting through the through hole, and a second end secured to the second hole respectively.

4. The ratchet wrench as claimed in claim 1 further comprising a knob releasably coupled to the driving member and configured to be rotated to turn the driving member, wherein upon rotating the knob clockwise the driving member is rotated clockwise, and wherein upon rotating the knob counterclockwise the driving member is rotated counterclockwise.

5. The ratchet wrench as claimed in claim 1, wherein each of the two pawls is under a resilient force of a biasing member, and wherein the direction control includes a projection which extends between the two pawls and which is adapted to move each of the two pawls to counteract a respective biasing member.

6. The ratchet wrench as claimed in claim 1, wherein the first plate includes a first through slot and the second plate includes a second through slot respectively, wherein the driving member includes a first driving end extending outside the first plate through the first slot and a second driving end extending outside the second plate through the second slot respectively, and wherein the object to be driven is engaged with one of the first and second driving ends.

7. The ratchet wrench as claimed in claim 6 further comprising a knob releasably coupled to another one of the first and second driving ends of the driving member and configured to be rotated to turn the driving member, wherein upon rotating the knob clockwise the driving member is rotated clockwise, and wherein upon rotating the knob counterclockwise the driving member is rotated counterclockwise.

8. The ratchet wrench as claimed in claim 1, wherein the first opening has a first contour, wherein the second opening has a second contour the same as the first contour, wherein the first plate is received in the second opening, and wherein the second plate is received in the first opening respectively.

9. The ratchet wrench as claimed in claim 1, wherein the main body has an upper brim edge, a lower brim edge, and an outer periphery extending between the upper and lower brim edges, and wherein the first plate is disposed flush with the upper brim edge and the second plate is disposed flush with the lower brim edge respectively.

10. The ratchet wrench as claimed in claim 1, wherein the main body includes at least one hollow out in communication with the at least one of the first and second openings.

11. A ratchet wrench comprising:

a main body made of rigid plastic and including a first opening, a second opening opposite the first opening, a first ledge surface, a second ledge surface opposite the first ledge surface, and a compartment extending therethrough and in communication with the first and second openings;

a first plate made of rigid metal having a contour correspondingly matching to a contour of the first opening and received in the first opening, with the first ledge surface supporting the first plate;

a second plate made of rigid metal having a contour correspondingly matching to a contour of the second opening and received in the second opening, with the second ledge surface supporting the second plate;

a ratchet driving assembly received by the compartment and positioned between the first and second plates, wherein the ratchet driving assembly includes a driving member and two pawls, wherein the driving member is rotatable about an axis and includes a gear, wherein the driving member is engaged with an object to be driven when using the ratchet wrench to drive the object, wherein the two pawls are made of rigid metal and are engagable with the gear of the driving member, wherein one of the two pawls is configured to allow the driving member to rotate clockwise and to inhibit the driving member from rotating counterclockwise while another of the two pawls is configured to allow the driving member to rotate counterclockwise and to inhibit the driving member from rotating clockwise, wherein the two pawls are disposed in a mirror image relationship, wherein the two pawls are anchored to at least one of the first and second plates and are configured to transmit a torque load to the at least one of the first and second plates, with the at least one of the first and second plates forming a first recess in communication with the compartment and with the two pawls each forming a first protrusion inserted in the first recess; and a direction control engagable with the two pawls and configured to cause each of the two pawls to move to a first position engaging the driving member and a second position disengaging from the driving member; and a torque-transmitting block received by the compartment, wherein the torque-transmitting block is anchored to the at least one first and second plates and is configured to transmit a torque load to the at least one of the first and second plates, wherein the first plate includes at least one first aperture, the main body includes at least one through aperture, and the second plate includes at least one second aperture respectively, wherein at least one fixer has a first end secured to the at least one first aperture, a middle inserting through the through aperture, and a second end secured to the second aperture respectively, wherein the two pawls are pivotally anchored to the at least one first and second plates and each first protrusion defines a pivot axis, and wherein the torque-transmitting block forms two concaves pivotally receiving the first protrusions of the two pawls.

12. A ratchet wrench comprising:

a main body made of rigid plastic and including a first opening, a second opening opposite the first opening, a first ledge surface, a second ledge surface opposite the first ledge surface, and a compartment extending therethrough and in communication with the first and second openings;

a first plate made of rigid metal having a contour correspondingly matching to a contour of the first opening and received in the first opening, with the first ledge surface supporting the first plate;

a second plate made of rigid metal having a contour correspondingly matching to a contour of the second opening and received in the second opening, with the second ledge surface supporting the second plate;

a ratchet driving assembly received by the compartment and positioned between the first and second plates, wherein the ratchet driving assembly includes a driving member and two pawls, wherein the driving member is rotatable about an axis and includes a gear, wherein the driving member is engaged with an object to be driven when using the ratchet wrench to drive the object, wherein the two pawls are made of rigid metal and are engagable with the gear of the driving member, wherein one of the two pawls is configured to allow the driving member to rotate clockwise and to inhibit the driving member from rotating counterclockwise while another of the two pawls is configured to allow the driving member to rotate counterclockwise and to inhibit the driving member from rotating clockwise, wherein the two pawls are disposed in a mirror image relationship;

a direction control engagable with the two pawls and configured to cause each of the two pawls to move to a first position engaging the driving member and a second position disengaging from the driving member; and a torque-transmitting block received by the compartment, wherein the torque-transmitting block is anchored to at least one first and second plates and is configured to transmit a torque load to the at least one first and second plates, with the at least one first and second plates forming a cavity in communication with the compartment and the torque-transmitting block forming a protrusion inserted in the cavity, and wherein the torque-transmitting block is configured to abridge a gap between two opposite lateral sides of the main body, with the torque-transmitting block having a lateral side in surface-to-surface contact with an inner periphery of the main body;

wherein the two pawls are received by the torque-transmitting block.

13. The ratchet wrench as claimed in claim 12, wherein the first plate includes a first through slot and the second plate includes a second through slot respectively, wherein the driving member includes a first driving end extending outside the first plate through the first slot and a second driving end extending outside the second plate through the second slot respectively, wherein the object to be driven is engaged with one of the first and second driving ends, and wherein one of the first and second driving ends forms a drive extension and another one of the first and second driving ends forms a socket respectively.

14. The ratchet wrench as claimed in claim 12, wherein the two pawls are pivotally anchored to the torque-transmitting block, with each of the two pawls including a first protrusion, and with the torque-transmitting block forming two concaves pivotally receiving the first protrusions of the two pawls.

15. The ratchet wrench as claimed in claim 12, wherein the main body has an upper brim edge, a lower brim edge, and an outer periphery extending between the upper and lower brim edges, and wherein the first plate is disposed flush with the upper brim edge and the second plate is disposed flush with the lower brim edge respectively.

16. The ratchet wrench as claimed in claim 12, wherein the main body includes at least one hollow out in communication with at least one of the first and second openings.

17. A ratchet wrench comprising:

a main body made of rigid plastic and including a first opening, a second opening opposite the first opening, a first ledge surface, a second ledge surface opposite the first ledge surface, and a compartment extending therethrough and in communication with the first and second openings;

a first plate made of rigid metal having a contour correspondingly matching to a contour of the first opening and received in the first opening, with the first ledge surface supporting the first plate;

a second plate made of rigid metal having a contour correspondingly matching to a contour of the second opening and received in the second opening, with the second ledge surface supporting the second plate;

a ratchet driving assembly received by the compartment and positioned between the first and second plates, wherein the ratchet driving assembly includes a driving member and two pawls, wherein the driving member is rotatable about an axis and includes a gear, wherein the driving member is engaged with an object to be driven when using the ratchet wrench to drive the object, wherein the two pawls are made of rigid metal and are engagable with the gear of the driving member, wherein one of the two pawls is configured to allow the driving member to rotate clockwise and to inhibit the driving member from rotating counterclockwise while another of the two pawls is configured to allow the driving member to rotate counterclockwise and to inhibit the driving member from rotating clockwise, and wherein the two pawls are disposed in a mirror image relationship;

a direction control engagable with the two pawls and configured to cause each of the two pawls to move to a first position engaging the driving member and a second position disengaging from the driving member;

a knob releasably coupled to the driving member and configured to be rotated to turn the driving member, wherein upon rotating the knob clockwise the driving member is rotated clockwise, and wherein upon rotating the knob counterclockwise the driving member is rotated counterclockwise; and a torque-transmitting block received by the compartment, wherein the torque-transmitting block is configured to abridge a gap between two opposite lateral sides of the main body, with the torque-transmitting block having a lateral side in surface-to-surface contact with an inner periphery of the main body, wherein the two pawls are received by the torque-transmitting block; and wherein the two pawls are pivotally anchored to the torque-transmitting block, with each of the two pawls including a first protrusion and the torque-transmitting block forming two concaves pivotally receiving the first protrusions of the two pawls.

18. The ratchet wrench as claimed in claim 17, wherein the first plate includes a first through slot and the second plate includes a second through slot respectively, wherein the driving member includes a first driving end extending outside the first plate through the first slot and a second driving end extending outside the second plate through the second slot respectively, wherein the object to be driven is engaged with one of the first and second driving ends, and wherein one of the first and second driving ends forms a drive extension and another of the first and second driving ends forms a socket respectively.

* * * * *